US006712324B2

(12) United States Patent
Catteau et al.

(10) Patent No.: US 6,712,324 B2
(45) Date of Patent: Mar. 30, 2004

(54) ELECTRONIC LABELING SYSTEM TO BE CARRIED BY THE CROSSPIECE OF A DISPLAY UNIT WITH A PEG

(75) Inventors: Dominique Catteau, Charenton-le Pont (FR); Bernard Joliey, Vernouillet (FR)

(73) Assignee: Store Electronic Systems-Electronic Shelf Label, Bezons (FR)

( * ) Notice: Subject to any disclaimer, the term of this patent is extended or adjusted under 35 U.S.C. 154(b) by 0 days.

(21) Appl. No.: 10/304,848

(22) Filed: Nov. 27, 2002

(65) Prior Publication Data

US 2003/0111580 A1 Jun. 19, 2003

(30) Foreign Application Priority Data

Nov. 27, 2001 (FR) ..... 01 15291

(51) Int. Cl.[7] ..... A47K 1/00

(52) U.S. Cl. ..... 248/222.51; 248/223.31; 248/225.11; 40/642.01; 40/657; 211/57.1

(58) Field of Search ..... 211/54.1, 57.1, 211/59.1; 206/464, 459.5, 459.1; 248/223.31, 224.8, 225.11, 222.51; 40/642.01, 657, 658, 642.02

(56) References Cited

U.S. PATENT DOCUMENTS 4,247,070 A * 1/1981 Dirksing ..... 248/226.5
4,436,269 A * 3/1984 Dirksing et al. ..... 248/214
4,805,861 A * 2/1989 Thalenfeld et al. ..... 248/225.1
5,044,588 A * 9/1991 Gunter ..... 248/214
5,683,003 A * 11/1997 Gebka ..... 211/57.1
5,901,487 A * 5/1999 Thalenfeld et al. ..... 40/642.01
5,946,839 A * 9/1999 Odmark ..... 40/642.01
6,126,125 A 10/2000 Dalton
6,279,256 B1 * 8/2001 Norolof et al. ..... 40/642.01
6,389,722 B1 * 5/2002 Josefsson et al. ..... 40/642.01

FOREIGN PATENT DOCUMENTS

WO WO 97/48862 12/1997

* cited by examiner

*Primary Examiner*—Korie Chan
(74) *Attorney, Agent, or Firm*—Young & Thompson

(57) ABSTRACT

A labeling system includes an open housing (3) having a bottom (37), an upper wing (31) and a lower wing (32), an electronic label (2) adapted to be positioned in the open housing (3) and having a hook (23, 24) coacting with the wings (31, 32) of the housing (3), a suspension element (4) with two walls (41, 42) disposed parallel to each other and connected by a cylindrical portion (43) adapted to be disposed astride the crosspiece (12) of a display unit with a peg (1), and a positioning device (35, 25, 45) which ensures the relative positioning and retention of the housing, of the label and of the suspension element, and which are inaccessible when the electronic label is positioned in the housing.

13 Claims, 2 Drawing Sheets

ELECTRONIC LABELING SYSTEM TO BE CARRIED BY THE CROSSPIECE OF A DISPLAY UNIT WITH A PEG

BACKGROUND OF THE INVENTION

The present invention relates generally to a system of electronic labeling.

Electronic labeling is widespread at present in stores, particularly large stores. Electronic labels are usually present in the form of a housing, generally fairly flat and rectangular parallelepipedal, on the front surface of which is disposed a display element such as a liquid crystal display screen. The display is controlled by a microprocessor, for example remotely controlled by the central computer of the store.

There is already known for example from the international application published under the number WO-98/58360, such an electronic label and a rail permitting positioning the latter on the front edge of the shelves of display cases on which are disposed products offered for sale.

The label and the rail comprise means ensuring emplacement of the label by snapping into the rail, which are such that although it is easy to emplace the label in the rail, it is impossible to move said label along the rail or to remove it from said rail without a suitable tool.

These means are constituted on the one hand by longitudinal grooves formed in two wings of the rail disposed facing each other and between which the label is to be positioned, and on the other hand by a rib formed on the surface of the label adapted to be engaged in the longitudinal groove of one of the wings of the rail, and a retractable finger urged by resilient means, mounted extending from the opposite surface of the label and adapted to be engaged in the longitudinal groove of the other wing of the rail. During emplacement of the label, said finger is inserted snap-fittingly in the longitudinal groove formed in said other wing of the rail and, after possible movement of the label for a short distance along the rail, in means such as blind openings formed in the bottom of said groove to immobilize said finger against translation in the longitudinal direction of the groove.

This arrangement permits providing an electronic labeling system which is very simple to use and which ensures that the label cannot be moved along the rail to be juxtaposed with products other than those whose characteristics it describes, or to be removed by more or less ill-intentioned persons.

U.S. Pat. No. 6,126,125 discloses a hooking device permitting fixing electronic labels to the shelves of a storage depot. The hooking device is formed of a single piece comprising a rail adapted to receive said label and a coupling element adapted to permit the securement of the label on the lower surface of the shelf. The hooking device permits protecting the electronic label and is adapted to be unhooked from the shelf in case of a shock, during movement of the shelves by elevation.

The document WO-97/48862 discloses an electronic label support permitting fixing an electronic label on a display unit comprising a rod. This support is constituted by a body adapted to receive the electronic label and an adaptor adapted to fix securely the body on a mounting portion. The body is fixed on the adaptor by means of attachments. The rod of the display unit is specially modified so as to comprise the mounting portion receiving the adaptor.

SUMMARY OF THE INVENTION

The object of the present invention is to provide a labeling system using the same labels not for products presented on shelves, but for packaged products in plastic film and carried by a display unit with a peg. Said labeling system is adapted in most cases to the forms which said peg can take and in particular when said peg comprises a T-shaped rod. In a manner known per se, the packaging of the product has an opening thanks to which it is threaded on the peg disposed perpendicularly to a fixed wall. Above the peg bearing the products offered for sale is disposed a rod terminating at its front end in a crosspiece perpendicular to it. The label is hooked to this crosspiece so as to be moved in rotation about the latter during removal or emplacement of the products carried by the peg.

To this end, the invention provides an electronic labeling system adapted to be carried by the crosspiece of a display unit with a peg, characterized in that it comprises:

- an open housing constituted by a bottom, an upper wing and a lower wing,
- an electronic label adapted to be positioned in said open housing, in the form of a flat rectangular parallelepipedal body whose front surface constituted by one of the large surfaces is provided with a display screen, and comprising a first hooking means coacting with a corresponding means on the upper wing of the housing and a second hooking means coacting with a corresponding means on the lower wing of the housing,
- a suspension element comprising two walls disposed parallel to each other and connected by a cylindrical portion adapted to be disposed astride the crosspiece of the display unit with a peg,
- positioning means ensuring with said first and second hooking means comprising the label and the corresponding means of the wings of the housing, the relative positioning and retention of said housing, label and suspension element, said positioning means being inaccessible when the electronic label is positioned in the housing.

The labeling system according to the invention is further remarkable in that:

- said positioning means are constituted by a pin on the housing, a blind hole on the label and axially aligned openings formed in the walls of the suspension element,
- the blind hole of the label is formed in the rear face of the body of the latter,
- the upper wing of the housing comprises a slot opening into a hollow recess in the bottom of the housing, said slot and said recess being adapted for the positioning of said walls of the suspension element,
- the pin of the housing is formed on the bottom of the recess and is of a length greater than the depth of said recess such that its end extends beyond the front of the bottom of the housing and is adapted to engage in the blind hole of the body of the label,
- the first hooking means is a retractable finger mounted in the body of the label, extending beyond the upper surface of the latter and being urged by a spring, and coacting with corresponding means of the upper wing of the housing,
- the second hooking means is a longitudinal groove formed in the lower surface of the body of the label coacting with a rib disposed longitudinally on the internal surface of the lower wing of the housing, the suspension element is of general L-shape, the cylindrical portion being disposed at the free end of the short leg of the L, said walls of the suspension element are bent substantially at a right angle so as to have a small portion and a large portion disposed perpendicularly to said small portion and adapted to be inserted in the housing, the corresponding means of the upper wing of the housing coacting with the first retractable hooking means mounted in the body of the label, is a groove disposed longitudinally in the internal surface of the upper wing of the housing, the corresponding means of the upper wing of the housing coacting with the first retractable hooking means mounted in the body of the label, is a blind hole disposed in the internal surface of the upper wing of the housing and opening through the facing surface of the lower wing of the housing, the upper wing of the housing comprises a throat disposed between said blind hole and a front surface of said upper wing of the housing, the lateral surfaces of said throat being closed, such that said retractable finger will be guided laterally upon being freed from the throat, and the surface of the bottom of the throat forming a guide ramp for the retractable finger which opens laterally into said blind hole, between the bottom of the blind hole and the internal surface of the upper wing, such that the retractable finger will snap into the blind hole after being freed from the throat, the housing comprises a second pin formed on the bottom of the recess and of a length equal to the depth of said recess, and in that the suspension element comprises second axially aligned openings formed in the walls, such that said second pin coacts with said second opening so as to ensure, with said positioning means, a rigid connection between the suspension element and the assembly of the housing and electronic label.

BRIEF DESCRIPTION OF THE DRAWINGS

The invention will be better understood from the description which follows, given by way of non-limiting example, with reference to the accompanying drawings, in which.

DESCRIPTION OF THE PREFERRED EMBODIMENTS

Figure 1:
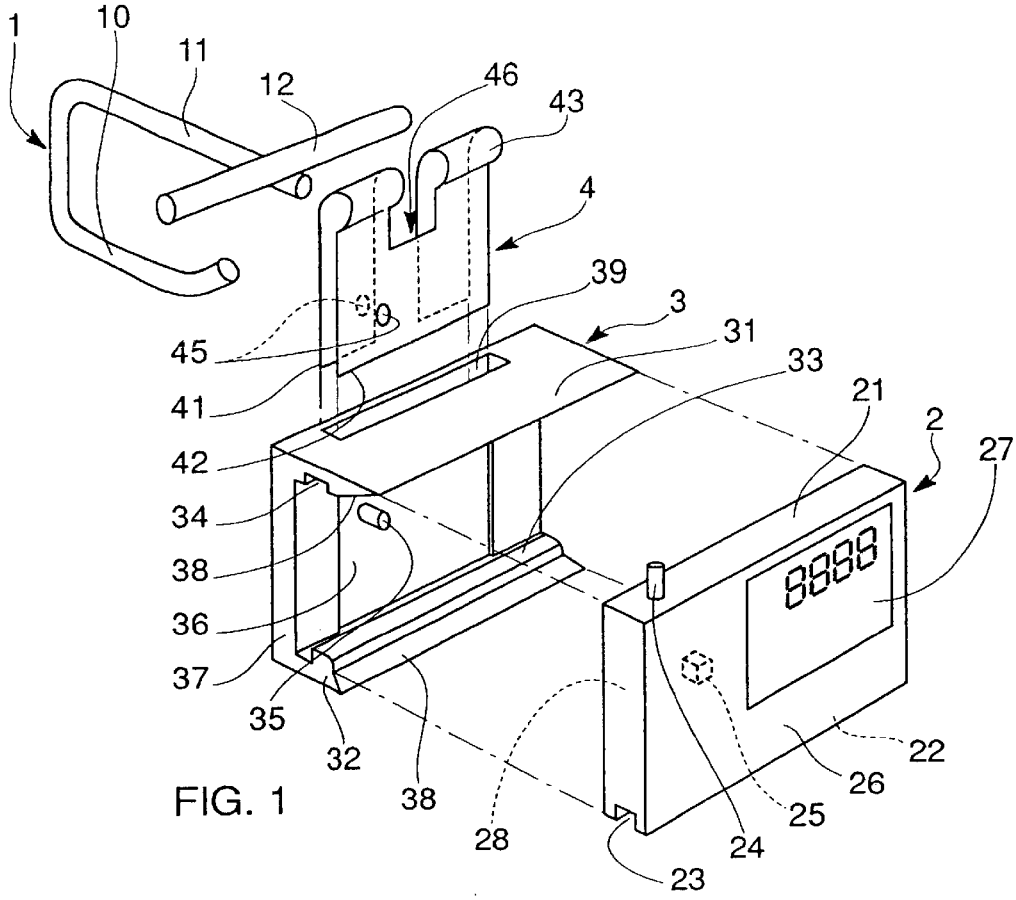
FIG. 1 is an exploded perspective view of the labeling system according to the invention and of the display unit with a peg that carries it.

As shown in FIG. 1, the labeling system according to the invention, suitable for products carried by a display unit with a peg 1, is comprised by an electronic label 2, a housing 3 and a suspension element 4.

The display unit with the peg 1 shown in the drawings, comprises a peg 10 on which are threaded packages of products offered for sale and a rod 11 extending parallel to the peg 10, above this latter. A crosspiece 12 is fixed to the end of the rod 11 perpendicular to the latter. The invention is of course applicable to any form of display unit with a peg, the latter always comprising no matter what their embodiment, the elements described above. As a modification, and in a way known per se, instead of being fixed at its middle to the rod 11, the crosspiece 12 can comprise an integral portion of said rod 11 and be obtained by bending the end of the latter, with the formation of a stop means at its free end such that the suspension element 4 cannot be removed by sliding it along the crosspiece.

The label 2 is similar to that described in the prior patent of the applicant, cited above. It is present in the form of a flat rectangular parallelepipedal body whose front surface 26 constituted by one of the large surfaces, is provided with a display screen 27, for example a liquid crystal one. A retractable finger 24 forming a first hooking means is mounted in the body of the label and extends beyond the upper surface 21 of the latter and is pressed by a spring (not shown in the drawing). A longitudinal groove 23 forming a second hooking means is formed in the lower surface 22, substantially at the middle of the latter.

The label body 2 also comprises a blind hole 25 in its rear surface 28.

A housing 3 is an open housing of overall C shape and is constituted by a bottom 37 and two wings 31, 32 extending perpendicularly to the bottom 37, at the top and bottom of this latter. The front ends of the wings 31, 32 have oblique surfaces 38 extending away from each other in a direction away from the bottom 37 of the housing 3.

The lower wing 32 has a longitudinal rib 33 formed at its internal surface turned toward the upper wing 31. The upper wing 31 has a longitudinal groove 34 formed in its internal surface turned toward the lower wing 32.

The upper wing 31 moreover comprises a slot 39 opening into a recess 36 formed in the bottom 37 of the housing 3.

A pin 35 is formed on the bottom of the recess 36. Said pin 35 is of a length greater than the depth of said recess 36 such that its end extends forwardly of the bottom 37 of the housing 3.

The suspension element 4 shown in FIG. 1, is of overall U shape. It is comprised be two walls 41, 42 disposed parallel to each other and connected by a cylindrical portion 43. A central notch 46 separates the cylindrical portion 43, the wall 41 and the wall portion 42 connected to the cylindrical portion 43 in two parts.

Each of the walls 41 and 42 is traversed by an opening 45, the two openings 45 being axially aligned.

As is seen in FIG. 1, the housing 3 is of dimensions such that the label 2 can be introduced between the wings 31 and 32 of the latter.

The suspension element 4 is adapted to be disposed astride the crosspiece 12 of the display unit with a peg 1. To this end, it is made in a way having a certain flexibility, for example of a rigid plastic sheet material, such that the walls 41, 42 can be spaced from each other. To position said suspension element 4 on the crosspiece 12, the walls 41, 42 are spread apart from each other so as, to position the two portions of the wall 41 on one side of the crosspiece 12 and on opposite sides of the rod 11, and the wall 42 on the other side of the crosspiece 12. The suspension element 4 is then moved perpendicularly to the crosspiece 12 until it is positioned in the cylindrical portion 43.

For the emplacement of the labeling system according to the invention on a display unit with a peg 1, the suspension element 4 is disposed on the crosspiece 12 as described above, then housing 3 is emplaced on said suspension element 4. To do this, the housing 3 is moved relative to said suspension element 4 such that the walls 41, 42 of this latter slide in the slot 39 and in the recess 36. An angular movement of the housing 3 relative to the suspension element 4 permits causing the walls 41, 42 to pass above the pin 35 until the openings 45 of the walls 41, 42 can be positioned about said pin 35. The depth of the recess 36 is preferably equal to the sum of the thicknesses of the two walls 41 and 42 of the suspension element 4, such that, after emplacement of the housing 3 on the suspension element 4 in the manner described above, this latter is flush with the front surface of the bottom 27 of the housing 3.

The label 2 is then emplaced in the support 3.

To this end, the label 2 is presented inclined forwardly so as to position the groove 23 of its lower surface 22 against the rib 33 of the lower wing 32 of said housing 3, this position being made possible by the oblique surface 38 of the wing 32.

A movement of rotation about said rib 33 brings together the label 2 and the bottom 37 of the housing 3. When the finger 24 is brought into contact with the oblique surface 38 of the upper wing 31, it is pressed inwardly of the body of the label 2. When the label 2 bears with its rear surface 28 against the bottom 37 of the body 3, the finger 24 is disposed facing the groove 34 of the upper wing 31 and can return to its initial position.

During this emplacement of the label 2 in the housing 3, the end of the pin 35 which extends beyond the bottom 37 of said housing 3, penetrates the blind hole 25 provided in the rear surface of the label 2.

The pin 35, the blind hole 25 of the label and the openings 45 of the suspension element 4, thus constitute positioning means which, in combination with the first 24 and second 23 hooking means carried by the label body 2 and the corresponding means of the upper wing 31 and lower wing 32 of the housing 3, ensure the relative positioning and retention of the three elements of the labeling system according to the invention: the suspension element 4, the housing 3, and the label 2. These means are preferably inaccessible when the label 2 is positioned in the housing 3, so as to avoid any improper removal from the system.

When the labeling system is positioned on the crosspiece 12 of the display unit with a peg, it is impossible to slide the label 2 between the wings 31, 32 of the housing 3 because it is held in position by the pin 35. It is impossible to remove the housing 3, because it is held in place by the coaction on the one hand of the groove 23 with the rib 33, and on the other hand of the finger 24 with the groove 34.

It is also impossible to disassemble the assembly of housing 3—label 2 from the suspension element 4, because of the positioning of the pin 35 in the openings 45.

There is thus obtained a secure mounting which cannot be unmounted without a specially suited tool.

As described in the mentioned international application, the label 2 can only be removed from the housing 3 when a suitable tool is used, provided with a magnetic means permitting withdrawing the finger 24 inwardly of the label body.

The portion of the suspension element 4 which extends above the upper wing 31 of the housing 3 and the portion of the central notch 46 which extends in the wall 42 of said suspension element 4, are of such dimensions that the suspension element 4 can be turned about the crosspiece 12 without this movement being prevented by the end of the rod 11, by the suspension element 4 or by the housing 3, so as to free the space necessary below the rod 11 to emplace or withdraw articles from the peg 10.

Figure 2:
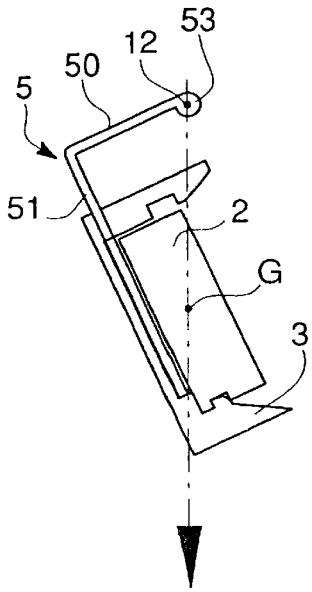
FIGS. 2 to 4 are transverse cross-sectional view of three embodiments of the labeling system according to the invention.
Figure 3:
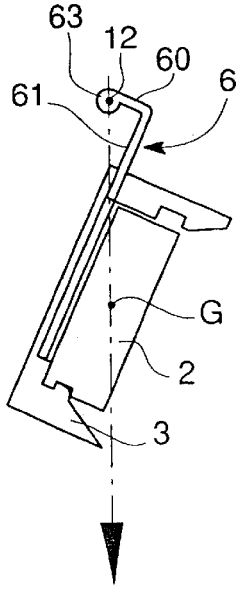
Figure 4:
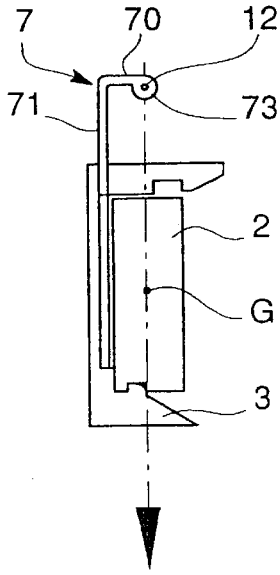

FIGS. 2 to 4 show three forms of embodiment permitting positioning the front surface of the label at different inclinations. Thus, the display screen 27 being constituted by a liquid crystal display, it is necessary that the reading axis be overall perpendicular to the surface of the screen. It is thus suitable that the labels positioned on the display units located at a mean height, have their front surface disposed substantially vertically, whilst those located on display units located at a greater or lesser height have their front surface inclined respectively downwardly or upwardly.

To this end, according to modified embodiments of FIGS. 2 to 4, the suspension element 5, 6, 7 is made with a general L shape, its cylindrical portion 53, 63, 73 being disposed at the front end of the short leg of the L.

The walls of suspension elements 5, 6, 7 are bent substantially at a right angle so as to have a small portion 50, 60, 70 and a large portion 51, 61, 71 disposed substantially perpendicular to the small portion and adapted to be inserted in the housing 3.

As is shown in FIGS. 2 to 4, when the system according to the invention is carried by the suspension element 4, it is oriented by gravity such that its center of gravity G will be in the vertical plane passing through the crosspiece 12. To obtain suitable inclination of the label 2, it suffices to modify the length of the small portion 50, 60, 70 and to position it either to the rear of or in front of the crosspiece 12.

The suspension element 5 of FIG. 2 has a small portion 50 of a relatively great length. When the latter is positioned behind the crosspiece 12 as shown, the label 2 is strongly inclined upwardly. A suspension element with such a small portion 50 of a relatively great length, positioned in front of the crosspiece, permits obtaining a mounting with the label 2 strongly downwardly inclined.

The suspension element 6 of FIG. 3 has a small portion 60 of medium length. When the latter is positioned in front of the crosspiece 12 as shown, the label 2 is medially inclined downwardly. A suspension element with such a small portion 30 of mean length positioned in front of the crosspiece, permits obtaining mounting with the label 2 medially inclined upwardly.

The suspension element 7 of FIG. 4 has a small portion 70 of short length, equivalent about to about half the thickness of the housing 3. When the latter is positioned behind the crosspiece 12 as shown, the label 2 is vertical. The same will be true with a suspension element whose small portion 70 of short length, equivalent about to half the thickness of the housing 3, would be positioned in front of the crosspiece.

The invention of course relates to any modified embodiment not shown in the drawing, and entering into the scope of the accompanying claims. By way of example, in a labeling system according to the invention adapted for a display unit with a peg, whose crosspiece 12 will be constituted by bending the end of the rod 11, with the formation of a stop means at its free end, the suspension element need not have a notch. It would thus be possible to position the pin 35 of the housing 3, the blind hole 25 of the label 2 and the openings 45 of the suspension element, longitudinally at the center of these latter such that said suspension element could be placed with one or the other of its walls in front of said crosspiece 12. This arrangement would be especially advantageous for suspension elements having walls bent substantially at a right angle, because they could be used either for elements placed high or for elements placed fairly low.

Figure 5:
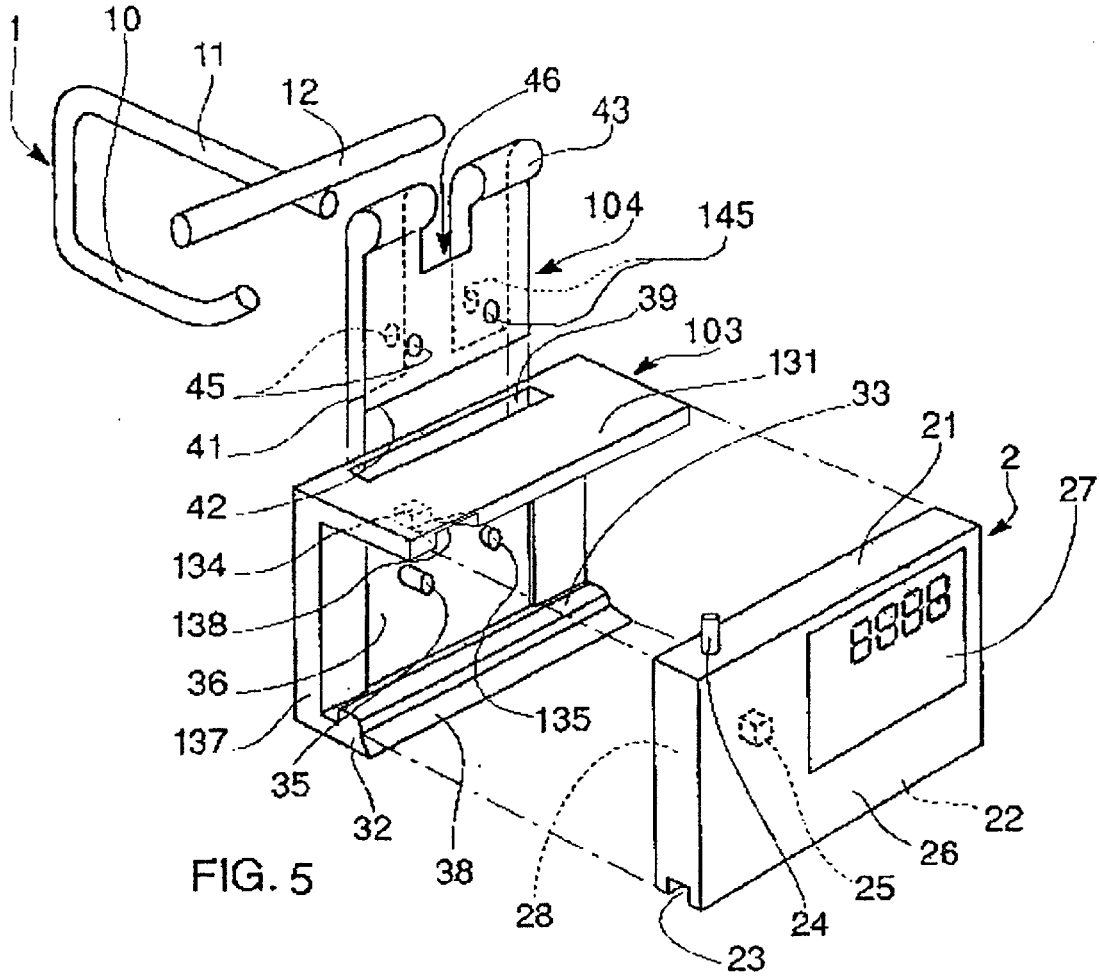
FIG. 5 is an exploded perspective view of a second preferred embodiment of the labeling system according to the invention and of the display unit with a peg which carries it.

FIG. 5 shows a second preferred embodiment of the hooking system according to the invention. In FIG. 5, elements identical to the first embodiment of the invention have the same reference numerals. In this embodiment, the first hooking means of the electronic label 2, constituted by the retractable finger 24, coact with a corresponding means which is a blind hole 134. This blind hole is provided in the upper wing 131 of the housing 103 and opens through the surface of the upper wing 131 facing the lower wing 132. In position, when the retractable finger 24 is engaged in the blind hole, and in combination with the other positioning means, any movement of the electronic label laterally relative to, the housing 103 is rendered impossible. In particular, in this second embodiment, the retractable finger 24, of metal and substantially unbreakable, positioned in the blind hole 134 prevents, during a strong lateral shock, any breakage of the plastic pin 35.

To permit the retraction of the retractable finger 24 during emplacement of the electronic label 2 on the housing 103, a throat 138 is provided between said blind hole 134 and the front surface of the upper wing 131. The surface of the bottom of the throat 138 is inclined and forms a guide ramp for the retractable finger 24. The guide ramp opens laterally into the blind hole 134 between the bottom of the blind hole and the surface of the upper wing 131. This particular arrangement permits the retractable finger 24 to be free from the front surface of the upper wing 131 and to snap into the blind hole 134. When the retractable finger 24 is brought into contact with the guide ramp of the throat 138, it is pressed inwardly of the label body 2. Once the electronic label 2 is disposed against the bottom 137 of the housing 103, the finger 24 is disposed facing the blind hole 134 and resumes its initial position.

Preferably, the side faces of the throat 138 approach each other to the extent that they approach the bottom 137 or the blind hole 134 of the housing 103. This arrangement has the advantage of guiding the retractable finger 24 during emplacement of the label on the support and hence of permitting correctly placing the electronic label 2 laterally relative to the support 103. Thus, the user can easily find the lateral position such that the pin 35 effectively penetrates the blind hole 25 provided in the rear surface of the label 2. This avoids the label 2 being in a laterally offset position it which the pin 35 bears on the rear surface 28 of the label 2 deforming it and generating large friction forces against the retractable finger 24 such that the suitable tool provided with magnetic means can no longer remove the label 2 by retracting the finger 24 toward the interior of the label body 2.

In this second embodiment of the invention, a second pin 135 is formed on the bottom of the recess 36. The second pin 135 is of a length substantially equal to the depth of said recess 36. Preferably, said second pin is disposed symmetrically relative to the pin 35 relative to a vertical plane of symmetry passing through the center of the housing 103.

Similarly, each of the walls 41 and 42 of the suspension element 104, in the second embodiment, is traversed by a second opening 145, the two second openings being axially aligned. The openings 145 and 45 are preferably disposed symmetrically relative to a vertical plane of symmetry passing through the center of the suspension element 104.

During emplacement of the housing 103 on the suspension element 104, the walls 41 and 42 pass above the pin 35, and hence above the second shorter pin 135, until the openings 45 in the walls 41 and 42 can be positioned about said pin 35 and the openings 145 of the walls 41 and 42 can be positioned about said second pin 135.

This particular arrangement of the second embodiment of the present invention permits rigidifying the connection between, on the one hand, the assembly constituted by the housing 103 and the electronic label 2 and, on the other hand, the suspension element 104, made of a plastic material, by bending sheets of plastic or by plastic injection in a mold, having a certain flexibility and hence an aptitude to be deformed. In particular, this avoids the suspension element 104 deforming and turning about the lug 35 of the housing. This second pin 135, forming a second hitching point of the securement element, is particularly interesting when the suspension element used is suspension element 5 of FIG. 2 comprising a portion 50 of relatively great length.

What is claimed is:

1. An electronic labeling system adapted to be carried by a crosspiece of a display unit with a peg, the system comprising:

an open housing having a bottom, an upper wing and a lower wing;

an electronic label in said open housing, said label having a rectangular parallelepipedal body whose front surface is provided with a display screen and first hooking means for engaging said upper wing and second hooking means for engaging said lower wing;

a suspension element having two walls disposed parallel to each other and connected by a cylindrical portion adapted to be disposed astride the crosspiece; and positioning means coacting with said first and second hooking means for ensuring a relative positioning and retention of said label in said open housing via said suspension element, said positioning means being inaccessible when said label is in said open housing.

2. The labeling system of claim 1, wherein said positioning means comprises a pin on said housing, a blind hole on said label, and axially aligned openings in said two walls through which said pin extends.

3. The labeling system of claim 2, wherein said blind hole is in a rear surface of said label and receives said pin.

4. The labeling system of claim 2, wherein said upper wing comprises a slot opening into a recess in said bottom, said two walls being inserted through said slot into said recess.

5. The labeling system of claim 4, wherein said pin is in said recess and has a length greater than a depth of said recess.

6. The labeling system of claim 4, wherein said housing comprises a second pin in said recess and having a length equal to the depth of said recess, and wherein said suspension element further comprises second axially aligned openings in said two walls through which said second pin extends to ensure, with said positioning means, a rigid connection among said suspension element, said housing and said label.

7. The labeling system of claim 1, wherein said second hooking means is a longitudinal groove in a lower surface of said label and wherein said lower wing has a longitudinal rib that engages said groove.

8. An electronic labeling system adapted to be carried by a crosspiece of a display unit with a peg, the system comprising:

an open housing having a bottom, an upper wing and a lower wing;

an electronic label in said open housing, said label having a rectangular parallelepipedal body whose front surface is provided with a display screen and first hooking means for engaging said upper wing and second hooking means for engaging said lower wing;

a suspension element having two walls disposed parallel to each other and connected by a cylindrical portion adapted to be disposed astride the crosspiece, said suspension element having a general L shape with said cylindrical portion being disposed at a free end of a short leg of said L shape; and positioning means coacting with said first and second hooking means for ensuring a relative positioning and retention of said label in said open housing via said suspension element, said positioning means being inaccessible when said label is in said open housing.

9. The labeling system of claims 8, wherein a long leg of said L shape is inserted into said housing and is substantially at a right angle to said short leg.

10. An electronic labeling system adapted to be carried by a crosspiece of a display unit with a peg, the system comprising:

an open housing having a bottom, an upper wing and a lower wing;

an electronic label in said open housing, said label having a rectangular parallelepipedal body whose front surface is provided with a display screen, hooking means for engaging said lower wing, and a finger that is urged beyond an upper surface of said label into engagement with said upper wing and that is retractable into said label;

a suspension element having two walls disposed parallel to each other and connected by a cylindrical portion adapted to be disposed astride the crosspiece; and positioning means coacting with said hooking means and said finger for ensuring a relative positioning and retention of said label in said open housing via said suspension element, said positioning means being inaccessible when said label is in said open housing.

11. The labeling system of claim 10, wherein said upper wing has a longitudinal groove along an internal surface thereof that engages said finger.

12. The labeling system of claim 10, wherein said upper wing has a blind hole in an internal surface thereof that engages said finger.

13. The labeling system of claim 12, wherein said upper wing comprises a throat between said blind hole and a front surface of said upper wing, surfaces of said throat forming a guide ramp for said finger and opening laterally into said blind hole so that said finger snaps into said blind hole after passing through said throat.

* * * * *